United States Patent [19]

Woodcock

[11] 4,206,915

[45] Jun. 10, 1980

[54] BASKETBALL PRACTICE DEVICE

[76] Inventor: Carl L. Woodcock, 27 Pearl St., Winchester, Ill. 62694

[21] Appl. No.: 24,880

[22] Filed: Mar. 28, 1979

[51] Int. Cl.[2] ..... A63B 63/00; A63B 69/00

[52] U.S. Cl. ..... 273/1.5 A

[58] Field of Search ..... 273/1.5 R, 1.5 A

[56] References Cited

U.S. PATENT DOCUMENTS

| | | | |
|---|---|---|---|
| 2,039,794 | 5/1936 | Hayden | 273/1.5 A |
| 2,694,572 | 11/1954 | Crisp | 273/1.5 A |
| 2,710,189 | 6/1955 | Carroll | 273/1.5 A |
| 3,160,414 | 12/1964 | Gray | 273/1.5 A |

*Primary Examiner*—Paul E. Shapiro

*Attorney, Agent, or Firm*—Gravely, Lieder & Woodruff

[57] ABSTRACT

This disclosure involves a basketball practice device adapted to be detachably mounted on a standard basketball goal to improve the form of the players in shooting goals. The device comprises a base which can be clamped to a standard basketball goal. This base has a plurality of radially outwardly extending members joined thereto. The outermost ends of the radially extending members have free-standing vertical elements so that they extend upwardly from the goal to deflect basketball shots having an undesirable trajectory.

9 Claims, 4 Drawing Figures

BASKETBALL PRACTICE DEVICE

BACKGROUND OF THE INVENTION

It is common knowledge among experts in the sport of basketball that it is desirable for a player to shoot the basketball with a high arch. Many beginning basketball players, however, shoot the ball at a low trajectory. Accordingly, basketball coaches are continually interested in devices and methods for teaching beginning players how to shoot the basketball properly.

Another problem in coaching basketball is to encourage players to shoot lay-ups from the proper angle of approach and to encourage a player shooting rebound shots to use the backboard.

Still another difficulty in coaching basketball is the problem of encouraging players to assume the proper position a sufficient distance from the basket to field balls as they rebound from missed shots.

Farley, U.S. Pat. No. 3,342,486 discloses a practice rail attachment which requires the use of clamps to attach the device to the backboard and could damage the backboard if a player should hang from the rim of the goal. Gray U.S. Pat. No. 3,160,414 discloses a basketball practice device which requires the player or coach to visually observe the "ears" of the device after a shot is taken to see if the trajectory was suitable. Consequently this type of device is not suitable for use in a basketball scrimmage involving teams actively playing.

Other patents relating to basketball practice devices include Dix, U.S. Pat. No. 3,348,840, Miller, U.S. Pat. No. 3,365,196 and Marschalk, U.S. Pat. No. 2,918,283. However, none of these patents relates to devices for improving shot trajectory and Marschalk and Dix decrease the size of the goal which tends to discourage the players in their shooting practice.

Therefore it is an object of my invention to provide a practice device which can be attached to a standard basketball goal and which aids in teaching players the proper shooting techniques in the sport of basketball.

One of the principal objects of the present invention is to provide a device which will deflect shots having a flat trajectory and will encourage shooters to place a higher arch or trajectory on a shot. Another object of the present invention is to provide a device which can easily be attached and detached to a basket without damaging the goal or the backboard.

A still further object of the present invention is to provide a device which encourages higher arched shots but still does not foreshorten the size of the goal so that it can be used during regular scrimmage and practice.

Still another object is to provide a device which can be used as a sighting aid by the player shooting the ball and which can be adjusted around the periphery of the goal.

Another object is to provide a device which will assist in improving the form of the player in shooting both distant and close-in shots and which will encourage players to position themselves a sufficient distance from the goal to capture missed shots on the rebound.

These and other objects and advantages will become apparent hereinafter.

SUMMARY OF THE INVENTION

This invention involves a basketball practice device which can be mounted on a standard basketball goal. The device comprises a plurality of radially extending legs projecting horizontally from a standard basketball goal, and, mounted upon each leg, a free-standing element which will deflect basketball shots having an undesirable trajectory.

DESCRIPTION OF THE DRAWINGS

In the drawings, wherein like numbers refer to like parts wherever they occur.

DETAILED DESCRIPTION

Figure 1:
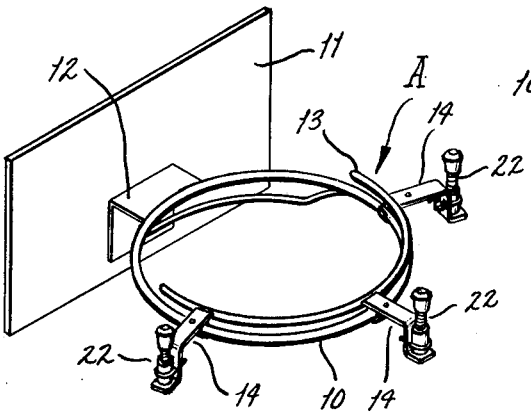
FIG. 1 is a perspective view of the device mounted in place on the goal.
Figure 4:
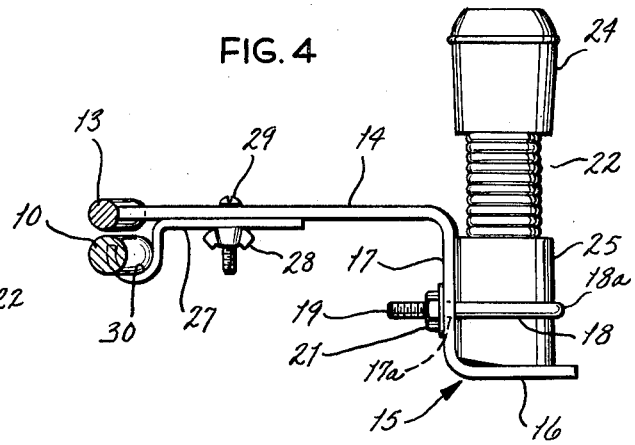
FIG. 4 is a vertical sectional view taken along line 4—4 of FIG. 2.
Figure 2:
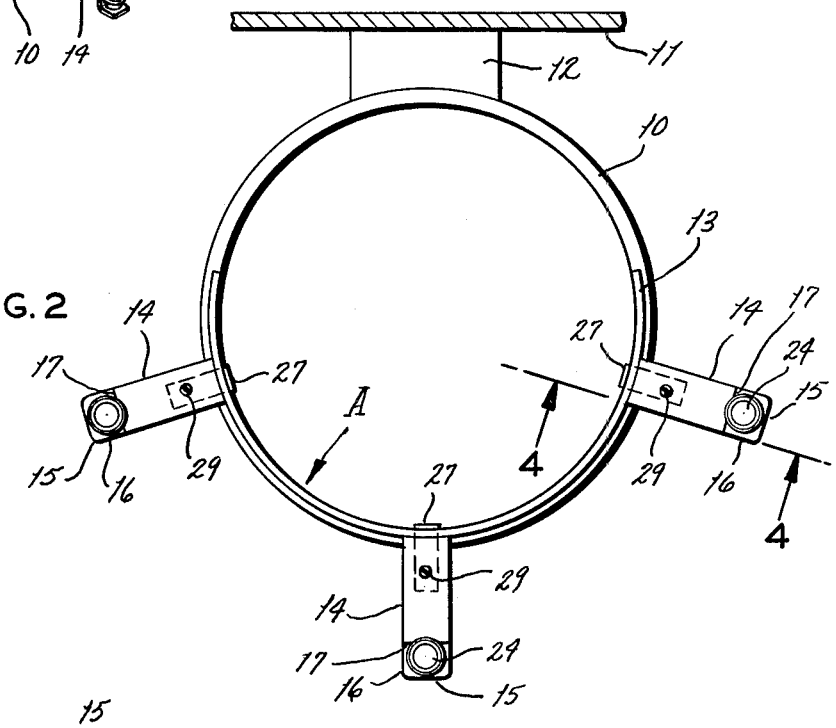
FIG. 2 is a fragmentary plan view of the preferred embodiment of the device.
Figure 3:
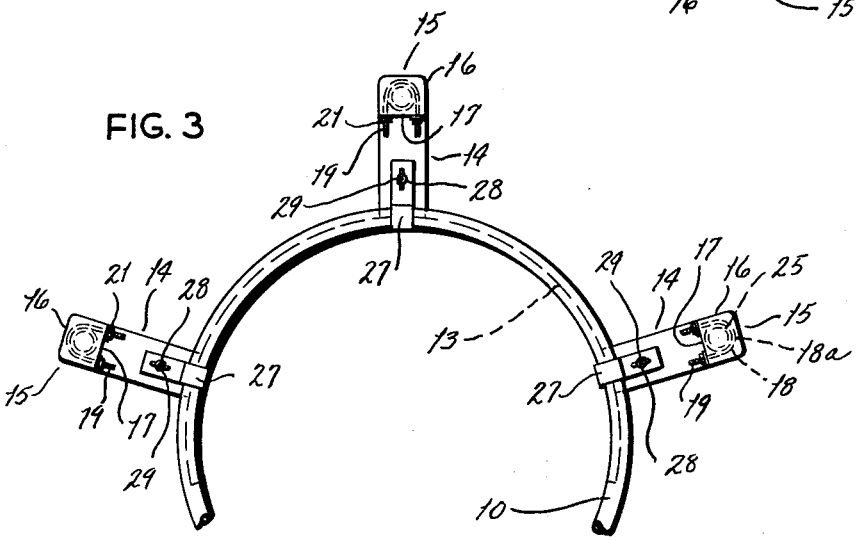
FIG. 3 is a bottom view of the preferred embodiment of the device.

A standard basketball goal 10 is mounted on a backboard 11 by means of a conventional bracketing arrangement 12.

Mounted on the goal 10 is the preferred embodiment of the device of the present invention, designated by the letter "A".

The preferred embodiment of the device comprises as a base a segment of a ring 13 (also called a C-ring) which has the same radius of curvature as the goal 10. The C-ring 13 has a plurality of radially extending legs 14, preferably three, projecting horizontally therefrom.

In the preferred embodiment, the radially extending legs 14 are joined to the C-ring 13 as by welding. However the legs 14 may be set in the desired position through direct attachment to the rim of the goal 10. Direct attachment, however, increases the possibility of movement of the legs and/or marring the surface of the rim of the goal 10. In lieu of a ring segment, an entire ring may also be satisfactorily employed.

Each leg 14 extends outwardly from the goal 10 about 4–6 inches. The outermost end 15 of each leg is bent into the shape of the letter L. The L has a horizontal base 16, and a vertical portion 17. The ring 13 and the legs 14 are preferably made of durable metal.

Upon the horizontal base 16 of the L is mounted a free-standing member 22 which projects at least about 2–4 inches over the rim of the conventional goal 10 when the device is properly mounted on said goal 10.

The free-standing member 22 may be of any suitable height. The height which is chosen is generally dependent upon the age level or level of proficiency of the players involved.

The purpose of the free-standing member is to prevent novice basketball players from shooting the basketball on a horizontal trajectory and to induce them to shoot high arching shots.

The free-standing members 22 are relatively narrow, and consequently the appearance of the goal to the player is not distorted. The free-standing members 22 should be spaced at such a distance that a conventional basketball cannot be shot between them without contacting them.

The free-standing member 22 is preferably made of resilient material in order to readily withstand the shock of flying basketballs. A coiled metal spring is the most suitable material for the resilient member. Hard rubber is also quite suitable. The top of the free-standing member 22 is capped with a knob 24 made of resilient material. The knob 24 is preferably made of rubber, or durable plastic, in order to prevent the basketball from being defaced by any rough edges on the free-standing member 22.

The preferred mode of mounting the free-standing member 22 to the leg 14 requires a sleeve 25 and a U-shaped clamp 18. The sleeve 25 is joined to the horizontal base 16 of the L-shaped end 15 of the leg 14. The free-standing member 22 is inserted into the sleeve 25, so that the sleeve 25 encloses the lower ⅓ to ½ the length of the free-standing member 22.

The free-standing member 22 is further secured to the leg 14 by a U-shaped clamp 18. The free-standing member 22 is in contact with the curved portion 18*a* of the clamp 18. The legs 19 of the clamp 18 pass through holes 17*a* bored in the vertical portion 17 of the L at the end 15 of the leg 14. The legs 19 of the clamp 18 are threaded and simple nuts 21 are used to hold the clamp 18. The forces exerted by the sleeve 25 and the U-shaped clamp 18 act to secure the free-standing member 22. The sleeve 25 is preferably made of a resilient or deformable material, such as hard rubber or plastic so that it will bear against the free-standing member 22 when the clamp 18 is secured to the leg 14.

The height of the upright member 22 in relation to the goal 10 can be adjusted by clamping more or less of the member 22 in the clamp 18.

The C-ring 13 can be attached to the goal 10 by a variety of methods. The preferred method is by means of brackets 27 which join the radially projecting legs 14. The brackets 27 and the radially projecting legs 14 both have holes drilled therethrough which are aligned when the C-ring 13, brackets 27, and goal 10 are in proper position. The brackets 27 are joined to the legs 14 by means of removable fasteners. Wing nuts 28 and bolts 29 are the preferred fasteners.

The bracket 27 has a groove 30 which is capable of receiving the goal rim. When the C-ring 13, brackets 27, and goal 10 are in proper position, the device is held in place by the clamping action of the C-ring 13 and the brackets 27 over the goal 10.

What is claimed:

1. A basketball practice device adapted to be mounted on a standard basketball goal comprising a plurality of members peripherally spaced around a conventional basketball goal, said members being positioned outwardly from said goal and including free-standing elements which extend above the horizontal plane of said standard goal to force a player to attempt an arched shot toward said goal, and means for attaching said members to said goal.

2. The device of claim 1 wherein each of said members has its outward end formed substantially into an L-shape having a horizontal base and a vertical portion and each of said free-standing elements is mounted on the horizontal base of the L-shaped portion of the member.

3. The device of claim 2 wherein the free-standing element is mounted on the horizontal base of the L-shaped portion of the member by (a) a sleeve which is joined to the horizontal base of the L-shaped portion of the member and into which the bottom end of said free-standing element is inserted, and (b) a U-shaped clamp, the legs of which are secured to the vertical portion of the L-shaped portion of the member, and the arcuate portion of which engages said free-standing element.

4. The device of claim 2 wherein the free-standing element is made of a resilient material capable of dissipating the shock caused by an object striking it.

5. The device of claim 4 wherein the free-standing element has a knob disposed at its top end to prevent damage from occurring to the basketball from said element.

6. The device of claim 1 wherein the means for attaching the members to said goal comprises:

(a) a base having a radius of curvature substantially equivalent to the radius of the goal,
(b) means for joining said members to said base,
(c) brackets adjustably fastened to said members,
(d) said base and said brackets cooperating to clamp said device to said goal.

7. The device of claim 6 wherein each of said brackets has a groove formed at one end thereof to engage said goal, said brackets being adjustably fastened to said members by means of a nut and bolt.

8. The device of claim 1 wherein the members are spaced at such a distance that a standard basketball cannot pass between the free-standing elements mounted on said members.

9. A basketball practice device adapted to be mounted on a standard basketball goal comprising:

(a) a ring shaped member having a radius of curvature substantially equal to the radius of the goal,
(b) a plurality of radially extending legs projecting horizontally from said ring shaped member, wherein said legs have their outermost end bent substantially into an L-shape,
(c) one free-standing element joined to each radially extending leg, wherein said element is mounted on the horizontal base of the L by means of (1) a deformable sleeve mounted on said horizontal base of the L-shaped portion of the leg, into which sleeve said free-standing element is inserted, and (2) a U-shaped clamp, the ends of which clamp are secured to the vertical portion of the L-shaped portion of the leg, the arcuate section of which clamp engages the element through the said deformable sleeve so as to stabilize said element, said element projecting a distance above the goal to prevent basketball shots having a trajectory from reaching said goal by deflecting said shots;
(d) brackets releasably joined to said ring shaped member on the radially extending legs by means of a tightenable fastener, each of said brackets having a groove in one end thereof to engage the goal itself.

* * * * *